United States Patent [19]

Hiller

[11] Patent Number: 4,911,220

[45] Date of Patent: Mar. 27, 1990

[54] REPLACEABLE DECORATIVE LOUVER COVERING SYSTEM

[76] Inventor: Kevin L. Hiller, 271 Driftwood La., Schaumburg, Ill. 60193

[21] Appl. No.: 176,445

[22] Filed: Apr. 1, 1988

[51] Int. Cl.[4] ..... E06B 9/00

[52] U.S. Cl. ..... 160/236; 60/900

[58] Field of Search ..... 160/236, 900

[56] References Cited

U.S. PATENT DOCUMENTS

| | | | |
|---|---|---|---|
| 2,074,482 | 3/1937 | Martens | 160/236 |
| 2,142,629 | 1/1939 | Clark, Jr. | 160/236 X |
| 2,207,420 | 7/1940 | Thomas | 160/900 X |
| 2,803,297 | 9/1957 | Wenke | 160/133 |
| 2,828,816 | 4/1958 | Nestor | 160/900 X |
| 3,031,045 | 4/1962 | Hallock | 160/236 X |
| 4,049,038 | 10/1977 | Hyman | 160/236 X |
| 4,195,680 | 4/1980 | Hyman | 160/236 X |
| 4,309,472 | 1/1982 | Götting et al. | 160/236 X |
| 4,628,980 | 12/1986 | Le Hovillier | 160/236 X |

*Primary Examiner*—Blair M. Johnson

*Attorney, Agent, or Firm*—Kareem M. Irfan

[57] ABSTRACT

A louver cover is provided for maximizing the decorative value of a louver used in louvered window coverings and the like. The louver cover includes an elongate tubular body 10 having dimensions sufficient to enclose a louver 14 therein. The louver cover is attached to the louver 14 contained therein by snaps 21 provided on one end of the tubular body 10. The louver cover is constructed of a flexible fabric. The flexible fabric is dyed or imprinted with an image. When associated with a plurality of louvers, the plurality of louver covers are positioned and colored to provide a large composite image to viewers on either side of the louvered covering. The louver cover provides for the variation of the color and function of the louvers presently in the consumer home.

12 Claims, 1 Drawing Sheet

REPLACEABLE DECORATIVE LOUVER COVERING SYSTEM

BACKGROUND OF THE INVENTION

1. Field of the Invention

This invention generally relates to a louver covering system for windows, doors, and the like, and more particularly, to a decorative louver cover constructed of a flexible fabric and easily installed on and removed from existing louvers.

2. Description of Related Art

Louvers and systems of louvers have been used extensively as decorative and functional coverings for windows, doors, and the like. Tens of thousands of systems utilizing louvers are sold in this country annually. Accordingly, louvered window coverings now serve a substantial functional and decorative role in many American homes. In view of this use, devices and methods have been developed to increase the decorative and functional value of the louver.

Paints and wallpapers have been utilized in an attempt to improve the ornamental value of the louver. Although, paints and wallpapers effectively change the appearance of the louver, they are permanently affixed to the exterior of the louver and are, therefore, not amenable to later decorative changes. When the decorative requirements of the louvers change, i.e., a change in color, it is necessary to replace the louvers themselves. Accordingly, the cost of redecorating is prohibitive.

A system has been described in U.S. Pat. No. 4,049,038, issued Sept. 20, 1977 to Hyman et al., which illustrates the use of interchangeable decorative panels. However, this system requires the fabrication of an entirely new type of louver. This louver is provided with flanges on each edge of an elongated panel forming an open faced channel to retain a stiff backed supporting sheet and a non-stiff decorative sheet. Thus, the appearance of the louver is altered by replacing the decorative sheet. The custom design of the louver panel prevents its widespread use in existing louver systems which employ a standard flat type louver. The decorative sheets cannot be effectively used on standard flat type louvers. Thus, those consumers who wish to redecorate standard louvers receive no benefit from the custom louver design.

A variation on this theme is illustrated in U.S. Pat. No. 4,195,680, issued Apr. 1, 1980 to Hyman et al. Using the specially constructed louver of '038, a plurality of colored transparent sheets are inserted into the louver channel. These colored transparent plastic sheets are used to create different colored louvers according to the tastes of the individual. Obviously, this system suffers from the same inherent disadvantage of the custom louver of '038 and cannot be applied generally to existing louvers.

The prior art louver covering systems provide a means for changing the decorative value of a louver, but, these systems permanently affix materials to the louver or require the consumer to purchase an entirely new type of louver system specially fabricated for this purpose. These options present no option at all to the consumer. The typical consumer does not have the financial resources to purchase new window coverings every time styles change. Furthermore, the consumer is not able or willing to purchase an entirely new window covering system with specially constructed louvers in order to have the option of redecorating.

Until now, the majority of consumers have been unable to cost effectively change the decorative value of the louvers they presently possess. In view of the large number of existing standard type louver systems, it would be highly desirable for a louver cover to be offered which could be inexpensively purchased and conveniently installed over existing louvered window coverings. It would also be desirable for a louver cover to be offered in a variety of colors, materials, patterns, and textures which could match or enhance any decor, and thereby facilitate redecorating.

SUMMARY OF THE INVENTION

An object of the present invention is to provide a decorative louver cover.

Another object of the present invention is to provide a decorative louver cover, the material, color, pattern and texture of which can be readily and economically varied.

It is still another object of the present invention to provide a decorative louver cover that can be readily installed over the louvers presently in consumer homes.

Yet another object of the present invention is to provide a decorative louver cover which has different colors or images on each side of the louver cover so that the louver cover presents a distinctly different visual image depending upon which side of the louver is displayed.

A still further purpose of the present invention is to provide a new louver covering system whereby each individual louver cover presents a visual image which comprises one part of a larger composite visual image created through the combination of a plurality of the louver covers.

To attain these and other objectives, a louver cover is provided which includes an elongate tubular body having first and second end portions and first and second side portions. The tubular body forms a channel having a circumferential and longitudinal length sufficient to dispose the louver therein. Also, means for removably attaching the tubular body to the louver is provided.

In another aspect of the present invention a covering system for a plurality of louvers includes a plurality of louver covers. Each louver cover includes an elongate tubular body having first and second end portions and first and second side portions. The tubular body forms a channel having a circumferential and longitudinal length sufficient to dispose one of the louvers therein. Means for removably attaching each of the covers to each of the louvers is also provided. The plurality of louver covers are positioned on the plurality of louvers to form first and second viewable panels respectively associated with the louver cover first and second side portions. The first and second viewable panels each display a composite desired image. Each of the composite desired images are constructed of a plurality of image sub-units. Each of the image sub-units are selected geographic sections of the first and second composite images respectively imprinted on the cover first and second side portions. Thus, alternately presenting the plurality of cover first and second side portions correspondingly presents the first add second composite images.

BRIEF DESCRIPTION OF THE DRAWINGS

Other objects and advantages of tee invention will become apparent upon reading the following detailed description and upon reference to the drawings in which.

Figure 2:
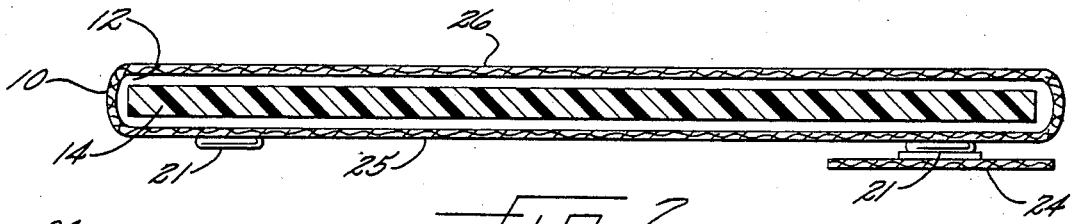
FIG. 2 is a cross sectional end view of the louver cover, taken along line 1—1 of FIG. 1.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 1:
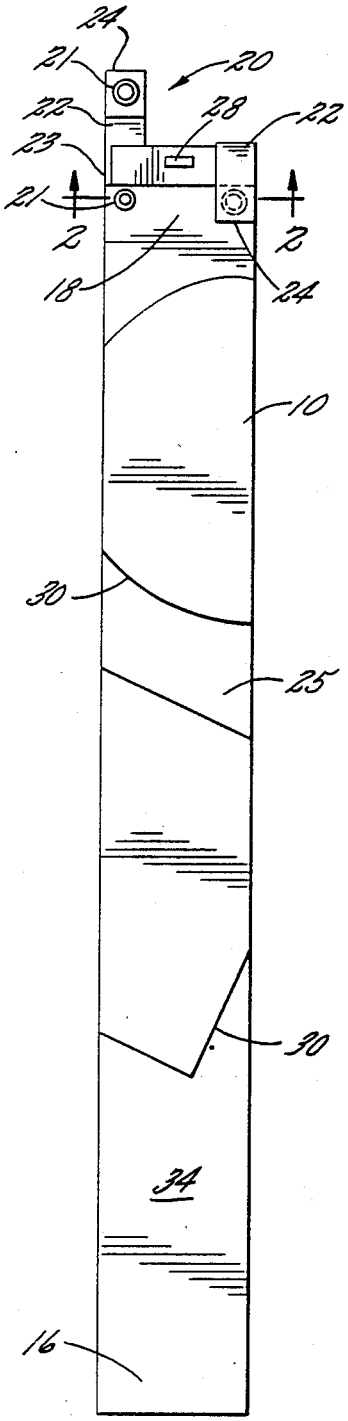
FIG. 1 is a plan view of one embodiment of the louver cover installed on a louver.
Figure 5:
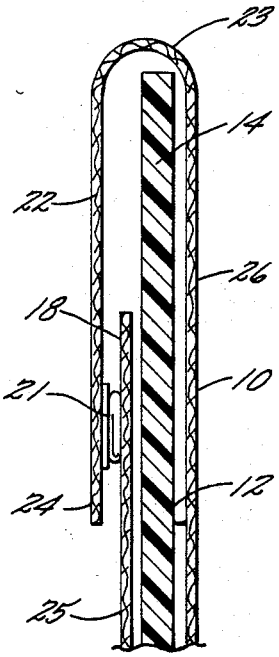
FIG. 5 is a cross sectional side view taken along 5—5 of FIG. 4.

Referring initially to FIG. 1, there is illustrated a louver cover. The louver cover includes an elongate tubular body 10 which forms a channel 12 (as seen in FIGS. 2 and 5). This channel 12 has a circumferential and longitudinal length sufficient to substantially enclose a louver 14 therein. It should be noted that the channel's dimensions are variable to accept a variety of sizes and shapes of louvers 14. However, the louver industry tends to produce louvers 14 only in a limited number of standard sizes. Thus, it is only necessary to produce the louver cover in a similarly limited number of standard sizes. Accordingly, the louver cover is suitable for use on louvers presently in the homes of consumers and there is no need to replace existing standard type flat louvers.

The tubular body 10 has a first end portion 16 and a second end portion 18. In one embodiment, both the first end portion 16 and the second end portion 18 are open. In another embodiment, the first end portion 16 s closed. The louver cover functions substantially the same in either of the above embodiments. The only difference being that, with the first end portion 16 closed, the louver cover tends to provide a closer fit over the louver 14. However, the open ended version allows lovers 14 of greater length to be installed in the louver covers since they are free to pass through the open end.

To install the louver 14 within the tubular body 10, the louver 14 is passed through the opening of the second end portion 18 and inserted into the channel 12. The body of the louver 14 is then urged along the length of channel 12 until substantially the entire body of the louver 14 is contained within the tubular body 10, as shown in FIG. 1. The louver cover is then attached to the louver 14. In one embodiment, attachment means 20 is connected to the second end portion 18 of the tubular body 10.

The attachment means 20 can take the form of any conventional attachment means such as snaps, ties, tapes, Velcro ®, or their equivalents. In the preferred embodiment, attachment means 20 includes a set of snaps 21. A pair of elongate bands 22 each have first and second end portions 23, 24. The band first end portions 23 are fixedly connected to the tubular body second end portion 18. This fixed connection can take the form of sewing, gluing, pinning, etc; however, in the preferred embodiment, the band first end portions 23 are sewn to the tubular body second end portion 18. The band second end portions 24 include one component of the snaps 21 affixed thereto. The corresponding components of the snaps 21 are affixed to the tubular body second end portion directly opposite the fixed connection between the band first end portion 23 and the tubular body second end portion. It should be apparent that the tubular body includes a first and second side portion 25, 26 (shown in FIG. 2). Thus, when both components of the snaps 21 are engaged the band first and second end portions are respectively attached to the tubular body second and first side portions 26, 25. Therefore, the bands 22 extend from the tubular body first side portion 25, over the louver 14, and to the tubular body second side portion 26 (shown in FIG. 5). The weight of the entire louver cover is supported by the bands 22 extending over and resting on the top of the louver 14. The attachment means 20 maintains the louver cover properly positioned, and affords convenient changing of the louver cover.

The louver cover is preferably constructed of a flexible fabric. The flexible fabric can be any one of many fabrics commonly used in the textile industry. Some examples of the fabrics which can be employed in this invention include, but are not limited to: cotton, silk, wool, and the synthetic polymer textiles. Synthetic polymer textiles such as nylon, polyester and the like are preferable because they are easily maintained and inexpensive.

Figure 3:
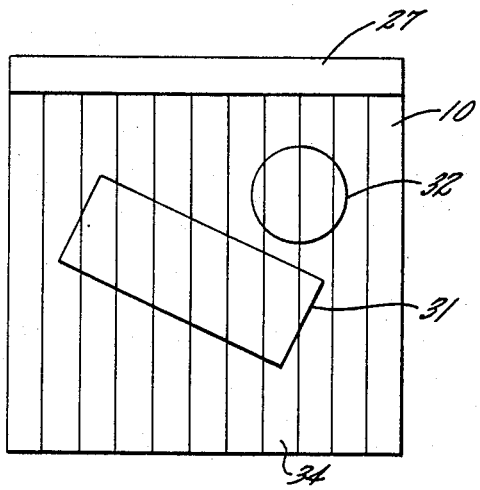
FIG. 3 is a front elevation of a louvered covering system illustrating the incorporation of the louver cover of FIG. 1 into a vertical louver system.

The flexible fabric is imprinted or dyed to present a desired color or pattern to the viewer. These colors or patterns are presented substantially on the first side portion 25 or second side portion 26 of the louver cover as seen in FIGS. 1 and 3. Since the louver cover has two side portions 25, 26, a color or pattern may be presented on each of the side portions 25, 26. Accordingly, the first side portion 25 and second side portion 26 may present the same or different colors or patterns. This feature provides the consumer with a louver cover which can change appearance by simply presenting the opposing side.

Figure 4:
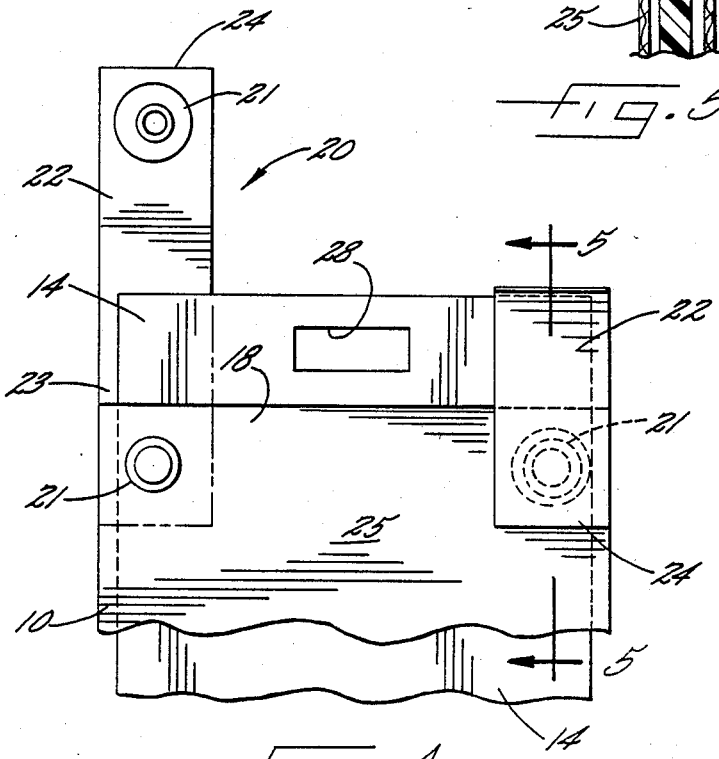
FIG. 4 is a detailed plan view of the second end portion louver cover and attaching means, taken along line 4—4 of FIG. 1.

The louver cover is used in association with an entire louvered window covering system and the like. FIG. 3 illustrates the incorporation of the louver cover of FIG. 1 onto a vertical louver 14, in association with a plurality of vertical louvers. The vertical louvers are retained and positioned by a support system 27 of a conventional design. Commonly, vertical louver support system 27 include a wide flat hooking member (not shown) which extends into a slot 28 (shown in FIG. 4) of the louver 14 to both hang the vertical louver 14 and effect control over its orientation. For example, by longitudinally rotating the flat hooking member, a similar longitudinal rotation is produced in the vertical louver 14. In FIG. 3 the louver covers of FIG. 1 are positioned to present only their first side portions to the viewer. Thus, the plurality of first side portions 25 create a single, large, composite, viewable panel. In one embodiment, all the louver covers of first side portions 25 are the same color. Thus, the viewer sees the viewable panel of FIG. 3 as a panel of solid color. This color is specially selected by the consumer to accommodate her personal tastes and decor. In another embodiment, all of the louver covers first side portions 25 do not present the same color. Instead, each first side cover has a color or pattern 30 such that each first side portion 25 is a visual sub-unit (see FIG. 1) of a larger composite image presented by the viewable panel of FIG. 3. For example, the viewable panel of FIG. 3 presents the geometric images of a rectangle 31 and a circle 32 to the viewer. Accordingly, the louver cover of FIG. 1, presents only a section of the composite visual image. For example, the design shown on the first side portion of the louver cover of FIG. 1 corresponds to the louver cover of FIG. 3 which is identified as elements number 34.

Further, the louver covers of FIG. 1 may be positioned to create two viewable panels similar to the panel of FIG. 3. The cover first side portions 25 create one viewable panel and the cover second side portions 26 create a second viewable panel. Each viewable panel, may present the same or distinctly different visual images. Therefore, different visual images may be presented to viewers positioned on either side of the louver window covering.

I claim:

1. A louver cover adapted to be fitted over a vertically disposed louver having an upper end adapted to be attached to a support system, and an unsupported lower end, said cover comprising:

an elongate tubular body including first and second side sections which define a channel adapted to substantially enclose therein the louver to be covered;

said tubular body including a top end which is open and through which the cover may be fitted over the lower end of said louver and pulled over the length of the vertically disposed louver until only a portion of said upper end of said louver projects outwardly from said open top end; and means for removably retaining said cover over the vertically disposed louver;

said retaining means are disposed on said tubular body about said open end and comprises at least one extension having a first end affixed to said first side section, and a second end adapted to be removeable affixed to said second side section.

2. The louver cover of claim 1, wherein said extension comprises an elongate band, whereby said cover is removeably retained over the louver enclosed within said channel by positioning said elongate band over said outwardly projecting portion of said louver upper end and affixing the second end of said elongate band to said second side portion.

3. A louver cover, as set forth in claim 1, wherein said tubular body has a bottom end which is closed.

4. A louver cover, as set forth in claim 1, wherein said tubular body is constructed from a fabric, said fabric being a textile selected from the group consisting of cotton, wool, silk, and synthetic polymer textiles.

5. A louver cover, as set forth in claim 1, wherein said first and second side portions are each imprinted with an image.

6. A louver cover, as set forth in claim 5, wherein said images imprinted on said first and second portions are substantially identical.

7. A louver cover, as set forth in claim 1, wherein said first and second side portions are each imprinted with a distinct image, whereby said first and second side portions are alternately viewable and present each distinct image.

8. A covering system for a plurality of vertically disposed louvers, each having an upper end adapted to be attached to a support system, and an unsupported lower end, the covering system comprising a plurality of louver covers, each louver cover adapted to be fitted over a vertically disposed louver and comprising:

an elongate tubular body including first and second side sections which define a channel adapted to substantially enclose therein the louver to be covered;

said tubular body including a top end which is open and through which the cover may be fitted over the lower end of said louver and pulled over the length of the vertically disposed louver until only a portion of said upper end of said louver projects outwardly from said open top end; and means for removably retaining said cover over the vertically disposed louver enclosed with said channel;

said plurality of louver covers being fitted over and retained on corresponding ones of said plurality of louvers to form, in combination, first and second viewable panels respectively associated with the first and second side sections of said louvers, said first and second viewable panels each displaying a desired composite image, each of said desired composite images comprising a plurality of image sub-units, each of said image sub-units being selected sections of the first and second composite images respectively imprinted on said first and second side sections of separate ones of said plurality of louvers, whereby the respective plurality of first and second side sections of said louvers, in combination, present said first and second composite images.

9. A louver covering system, as set forth in claim 8, wherein said retaining means is disposed on said tubular body about said open top end and comprises at least one elongate band having a first end affixed to said first side section, and a second end adapted to be removably affixed to said second side section, whereby said cover is removably retained over the louver enclosed within said channel by positioning said elongate band over said outwardly projecting portion of said louver upper end and affixing the second end of said elongate band to said second side section.

10. A louver covering system, as set forth in claim 8, wherein said tubular body has a bottom end which is closed.

11. A louver covering system, as set forth in claim 8, wherein said tubular body is constructed from a fabric, said fabric being a textile selected from the group comprising cotton, wool, silk, and synthetic polymer textiles.

12. A louver covering system, as set forth in claim 8, wherein said composite desired image displayed on said first and second viewable panels are distinct.

* * * * *